US006488562B1

(12) United States Patent
Liu

(10) Patent No.: US 6,488,562 B1
(45) Date of Patent: Dec. 3, 2002

(54) LOBSTER-SHAPED BUILT-UP TOY

(76) Inventor: Kuo-Ching Liu, 5Fl., No. 11, Alley 1, Lane 1, Sec. 1, Yunhan S. Rd., Lujou City, Taipei (TW), 247

( * ) Notice: Subject to any disclaimer, the term of this patent is extended or adjusted under 35 U.S.C. 154(b) by 0 days.

(21) Appl. No.: 09/951,980

(22) Filed: Sep. 14, 2001

(51) Int. Cl.[7] ..... A63H 3/16
(52) U.S. Cl. ..... 446/387; 446/97
(58) Field of Search ..... 446/368, 391, 446/390, 387, 388, 85, 97, 101, 105, 385, 153

(56) References Cited

U.S. PATENT DOCUMENTS 2,365,098 A * 12/1944 Nudelman ..... 446/376
4,526,553 A * 7/1985 Guerrero ..... 446/380
5,458,521 A * 10/1995 Todd ..... 446/73
6,120,344 A * 9/2000 Brown ..... 446/321

* cited by examiner

*Primary Examiner*—Jacob K. Ackun
*Assistant Examiner*—Faye Francis
(74) *Attorney, Agent, or Firm*—Troxell Law Office PLLC

(57) ABSTRACT

A lobster-shaped toy is built up from a plurality of modeled parts including a main body part, a lower carapace part, two antenna parts, a plurality of segmental shell parts, two claw parts, and a telson part. All these modeled parts are connected to one another through engagement of slits provided thereon and thereby form a three-dimensional toy lobster. These parts are also provided with patterns showing specific features that are usually found on a real lobster, so that the assembled toy lobster is vivid to attract more players and helps players to know more things about the lobster.

1 Claim, 2 Drawing Sheets

LOBSTER-SHAPED BUILT-UP TOY

FIELD OF THE INVENTION

The present invention relates to a lobster-shaped toy, and more particularly to a lobster-shaped toy built up from a plurality of modeled parts, so that a player learns more things about the lobster from assembling the modeled parts.

BACKGROUND OF THE INVENTION

The built-up toy is presently one of the most welcomed toys among children. It enables a player to enjoy the pleasure of assembling different parts into an embodied toy through thinking and imagination.

The currently available built-up toys are generally divided into two types, namely, modularized built-up toys and imitative built-up toys. A modularized built-up toy usually includes a plurality of modules that have a uniform shape, such as round, polygonal modules and the like. An imitative built-up toy usually has an appearance imitating or converted from a real thing in our life, such as some kind of animal or mechanical structure, and includes a plurality of modeled parts that representing different and distinct areas featuring the real thing being imitated. The modules included in a modularized built-up toy could be freely assembled to one another completely through a player's creative ideas. The player may freely build up various kinds of predefined or imaginary figures from the uniform modules. However, from the standpoint of helping a player, particularly a child, to understand the structure of a real thing from assembling of the built-up toy, the imitative built-up toys would be a preferred choice.

In the production of conventional imitative built-up toys, the imitated items are usually roughly divided into only a few major parts. Therefore, the imitative toys built up from these parts do not present overall appearances and particulars as close as possible to the real things being imitated. That is, there is a considerable difference between the toys built up from the roughly divided parts and the real things being imitated. Thus, the assembled toys do not enable the players to have an idea about the exact three-dimensional configurations of the real things being imitated.

Moreover, the conventional built-up toys are usually made to a rather small scale to the real things. This condition and still many other factors prevent the imitative built-up toys from showing more detailed features of the real things to attract and educate players.

SUMMARY OF THE INVENTION

It is therefore a primary object of the present invention to provide an improved built-up toy that eliminates the drawbacks existing in the conventional imitative built-up toys so as to present a three-dimensional body and more distinct features of a real thing being imitated.

In an embodiment of the present invention, a lobster-shaped built-up toy is provided. The toy includes a plurality of modeled parts separately representing distinct areas of a real lobster and having patterns painted thereon to show features of the lobster. These modeled parts are connectable to one another through tight-fitting slits provided thereon, so that an attractive three-dimensional toy lobster is formed.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

Figure 1:
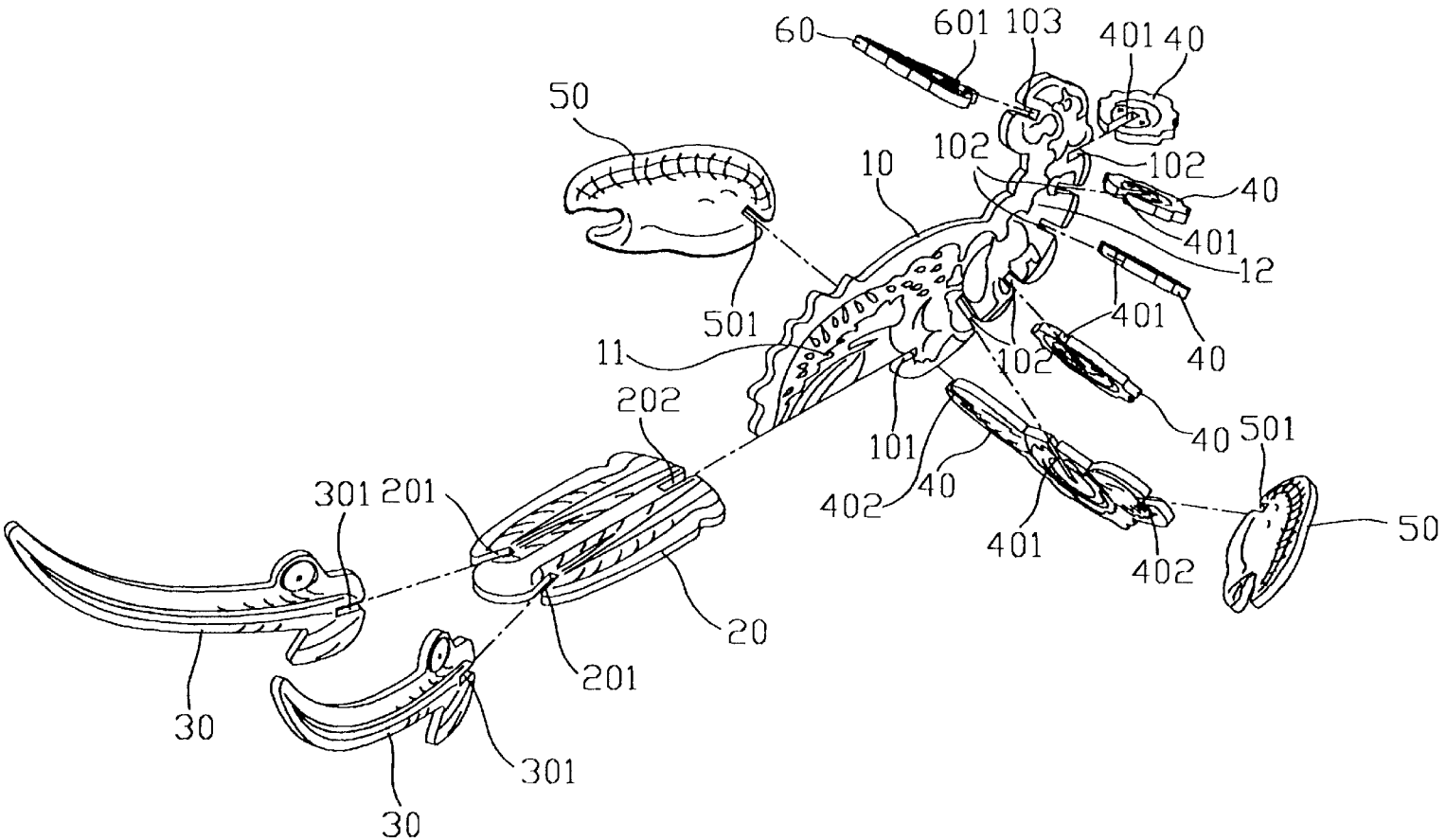
FIG. 1 is an exploded perspective view of a lobster-shaped built-up toy according to an embodiment of the present invention.

Please refer to FIG. 1 that is an exploded perspective view of a lobster-shaped built-up toy according to an embodiment of the present invention. As shown in FIG. 1, the lobster-shaped toy is built up from a plurality of modeled parts that generally represent some specific and featuring areas of a lobster. These modeled parts mainly include a main body part 10, a lower carapace part 20, two antenna parts 30, a plurality of segmental shell parts 40, two claw parts 50, and a telson part 60.

The main body part 10 includes a carapace portion 11 and an abdomen portion 12 behind the carapace portion 11, and is provided at front, middle, and rear sections with a first slit 101, a plurality of second slits 102, and a third slit 103, respectively.

The lower carapace part 20 is a flat member in the shape of a carapace of a lobster when it is viewed from a top thereof. The lower carapace part 20 is provided at a front end with two fourth slits 201, and at a rear end with a fifth slit 202 for engaging with the first slit 101 on the main body part 10.

Each of the two antenna parts 30 is an elongated member in the shape of an antenna of a lobster and is provided at a rear end with a sixth slit 301 for engaging with the fourth slit 201 at the front end of the lower carapace part 20.

The number of the segmental shell parts 40 corresponds to that of the second slits 102 provided at the middle section of the main body part 10. Each of the segmental shell parts 40 is provided at a predetermined position with a seventh slit 401 for engaging with the second slit 102. One of the segmental shell parts 40 that is to be engaged with the most front second slit 102 is provided at two outer ends with two eighth slits 402.

Each of the two claw parts 50 is a flat member showing the shape of a claw of a lobster and is provided at a predetermined position with a ninth slit 501 for engaging with the eighth slit 402 on the most front segmental shell part 40.

The telson part 60 is a flat member showing the shape of a telson of a lobster and is provided at a predetermined position with a tenth slit 601 for engaging with the third slit 103 provided at the rear section of the main body part 10.

Figure 2:
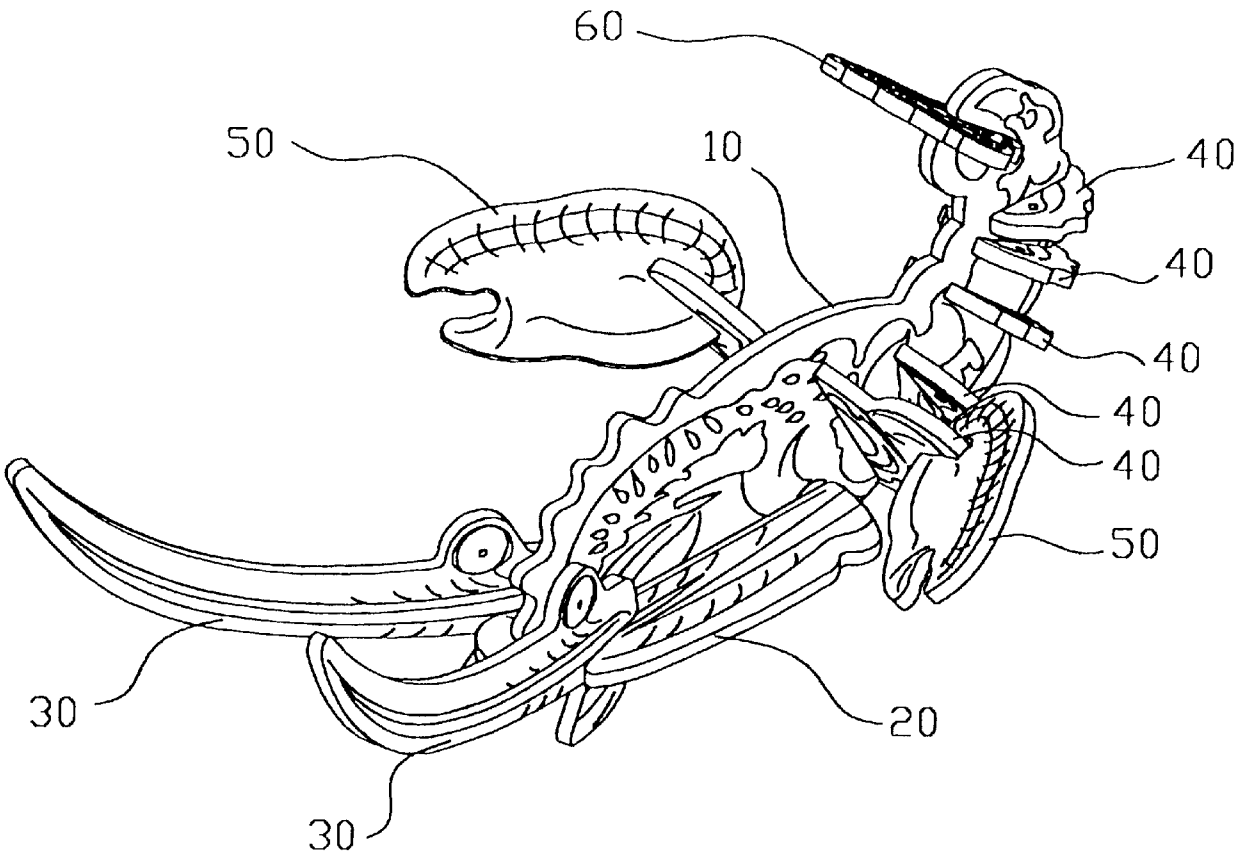
FIG. 2 is a fully assembled perspective view of the lobster-shaped built-up toy of FIG. 1.

With the above arrangements, it is possible to connect the main body part 10, the lower carapace part 20, the antenna parts 30, the segmental shell parts 40, the claw parts 50, and the telson part 60 together through engagement of the slits provided on them, as shown in FIG. 2.

A player may connect the parts 10, 20, 30, 40, 50 and 60 to one another step by step in accordance with the following instructions:

1. Connect the lower carapace part 20 to the main body part 10 through engagement of the fifth slit 202 on the lower carapace part 20 with the first slit 101 on the main body part 10, so as to form a three-dimensional carapace of a lobster;

2. Connect the two antenna parts 30 to the lower carapace part 20 by engaging the sixth slits 301 on the antenna parts 30 with the fourth slits 201 on the lower carapace part 20, so that the antenna parts 30 extend forward from the lower carapace part 20 and the main body part 10;
3. Connect the segmental shell parts 40 to the main body part 10 one by one through engagement of each seventh slit 401 on the segmental shell part 40 with one of the second slits 102 on the main body part 10, so that the segmental shell parts 40 are sequentially located at a lower side of the main body part 10 in planes perpendicular to the main body part 10;
4. Connect the two claw parts 50 to two sides of the main body part 10 by engaging the ninth slits 501 on the claw parts 50 with the eighth slits 402 provided at two ends of the most front segmental shell part 40; and
5. Connect the telson part 60 to the main body part 10 by engaging the tenth slit 601 with the third slit 103 provided at the rear section of the main body part 10.

The assembled modeled parts together form a three-dimensional lobster-shaped toy, as shown in FIG. 2. The modeled parts generally present a full configuration as well as many particular areas of the lobster. However, to present the lobster as real as possible, each of the modeled parts 10, 20, 30, 40, 50 and 60 may be painted to show specific patterns that are usually found on the lobster.

Thus, the built-up toy of the present invention not only shows an overall appearance of the lobster, but also many particular areas thereof for a player to know more things about the lobster.

Further, to enable firm connection of the main body part 10, the lower carapace part 20, the antenna parts 30, the segmental shell parts 40, the claw parts 50, and the telson part 60 to avoid undesired separation of them from one another at the engaged slits, all the slits 101, 102, 103, 201, 202, 301, 401, 402, 501 and 601 are designed to engage with one another in a tight-fit relation.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A lobster-shaped built-up toy comprising a plurality of modeled parts, and comprising:

a main body part including a carapace portion and an abdomen portion behind said carapace portion, and being provided at front, middle, and rear sections with a first slit, a plurality of second slits, and a third slit, respectively;

a lower carapace part being a flat member, said lower carapace part being provided at a front end with two fourth slits, and at a rear end with a fifth slit engaging with said first slit on said main body part;

two antenna parts, each being an elongated member and each provided at a rear end with a sixth slit engaging one of said two fourth slits at the front end of said lower carapace part;

a plurality of segmental shell parts corresponding in number to the plurality of said second slits provided at the middle section of said main body part; each of said segmental shell parts provided with a seventh slit engaging with one of said plurality of second slits; one of said segmental shell parts engaged with a front most one of said plurality of second slits, being provided at two outer ends with two eighth slits;

two claw parts, each of which being a flat member and each being provided with a ninth slit engaging with one of said two eighth slits on said segmental shell part; and a telson part being a flat member and being provided with a tenth slit engaging with said third slit provided at the rear section of said main body part.

* * * * *